United States Patent [19]

Darrow

[11] Patent Number: 4,743,363

[45] Date of Patent: May 10, 1988

[54] CLASSIFYING CYCLONE

[75] Inventor: David S. Darrow, Portville, N.Y.

[73] Assignee: The Dexter Corporation, Windsor Locks, Conn.

[21] Appl. No.: 911,475

[22] Filed: Sep. 25, 1986

[51] Int. Cl.[4] ..... B07B 4/02

[52] U.S. Cl. ..... 209/138; 55/261; 55/459.1; 209/144; 209/148; 210/456; 210/512.3

[58] Field of Search ..... 209/144, 140, 148–150, 209/152, 138, 139.1, 211; 55/261, 450 R, 435; 210/512.3, 456

[56] References Cited

U.S. PATENT DOCUMENTS

| | | | |
|---|---|---|---|
| 2,252,581 | 8/1941 | Saint-Jacques | 209/144 |
| 2,968,401 | 1/1961 | Sheldon | 209/144 |
| 3,232,430 | 2/1966 | Saint-Jacques | 209/144 |
| 3,306,443 | 2/1967 | Sereno et al. | 209/143 |
| 3,667,600 | 6/1972 | Oietal | 209/144 |
| 3,670,886 | 6/1972 | Hosokawa | 209/144 |
| 3,802,570 | 4/1974 | Dehne | 210/304 |
| 3,988,133 | 10/1976 | Schady | 55/459 R |
| 4,200,415 | 4/1980 | Boring | 406/173 |
| 4,272,260 | 6/1981 | Klein et al. | 55/265 |
| 4,303,421 | 12/1981 | Cerroni | 55/290 |
| 4,526,678 | 7/1985 | Myhren et al. | 209/144 |

FOREIGN PATENT DOCUMENTS

| | | | |
|---|---|---|---|
| 628291 | 4/1936 | Fed. Rep. of Germany | 209/144 |
| 320726 | 5/1957 | Switzerland | 209/144 |
| 476890 | 12/1973 | United Kingdom | 209/144 |

OTHER PUBLICATIONS

Three Fisher-Klosterman, Inc. drawings—Drwg. Nos. FK 907 D1, FK 908 D1, and FK 909 D1.

Sales brochure for the Rema Aerosplit and Microsplit Air Classifiers, pp. 2–3.

Chapter 4, "Cylcone Classifier", pp. 4.1–4.4 from a workbook of the Bulk Powder and Solids show in May 1986 in Chicago, IL.

*Primary Examiner*—Robert B. Reeves

*Assistant Examiner*—Donald T. Hajec

[57] ABSTRACT

A classifying cyclone efficient at removing very fine particles. In preferred embodiments, the cyclone employs an annular bevel ring positioned along the interior wall to redirect separated particles from the wall back into the path of classifying air. A control air deflector is placed in the path of the classifying airstream and adjusted vertically to provide adjustment of the annular orifice through which the classifying air passes. The air deflector is positioned at approximately the height of the bevel ring.

9 Claims, 1 Drawing Sheet

CLASSIFYING CYCLONE

BACKGROUND OF THE INVENTION

This invention relates to classification, i.e., removal of fine particles from coarser particles in gas streams. Frequently it is desirable to separate very fine particles (e.g., less than 5 microns) from coarser particles. In one typical application, epoxy coating, heated parts are passed through a fluidized bed of ground epoxy particles. This bed of particles should contain no very fine particles, hence the need for classification.

Two approaches are known in the field, rotating classifiers and cyclone classifiers. Rotating classifiers are subject to high power consumption, high noise generation, and unbalance susceptibility. Cyclone classifiers avoid these drawbacks, yet have been ineffective in removing very fine particles.

In a typical cyclone classifier, one stream of air, containing particles, circulates and swirls around inside a cylindrical housing. Inertial, or centrifugal, forces tend to move the particles toward the outer wall of the housing. A second stream of air, flowing perpendicularly to the first, is intended to entrain and remove the fine particles while leaving the coarse particles behind. In general, these cyclones achieve adequate removal of some fine particles (e.g., 5–10 microns in length) but are inefficient at removing very fine particles (e.g. less than 5 microns).

SUMMARY OF THE INVENTION

I have discovered that classifying cyclones can be made much more efficient at removing very fine particles by redirecting separated particles from the outer wall of the cyclone back into the path of the classifying air. In preferred embodiments, particles are redirected by an annular ring located on the wall of the cyclone; the top of the ring is beveled at an angle of 30° to 45° from horizontal; the ring is from 0.5% to 33%, and preferably 3% to 5%, of the internal diameter of the cyclone; an air deflector is placed in the path of the classifying airstream, forming an annular orifice through which the classifying air flows; the air deflector is tapered (e.g., conical) and vertically movable, to allow adjustment of the size of the annular orifice, thus controlling the velocity of the classifying air and the overall efficiency of the cyclone.

It is believed that improved classifying efficiency results because very fine particles travelling downwardly along the wall beneath coarser particles, and thus shielded from the classifying air, are forced back into the classifying air. The very fine particles tend to end up beneath coarser particles because of the inertial forces pushing the particles outwardly; the smallest particles are able to pass through interstices between coarser particles, and thus end up closest to the wall. In prior art classifying cyclones, those very fine particles that reached the wall in the upper portion of the cyclone were allowed to fall downwardly along the wall, shielded from further effects of the classifying air.

In a second aspect, the invention features using the bevel ring in nonclassifying cyclones, for its ability to prevent the conical lower housing of the cyclone from becoming coated with very fine particles. With the bevel ring installed, the interior of the lower housing, which would have required cleaning in a conventional cyclone, is left glistening clean.

Other features and advantages of the invention will be apparent from the following description of the preferred embodiment and from the claims.

DESCRIPTION OF THE PREFERRED EMBODIMENT

Figure 1:
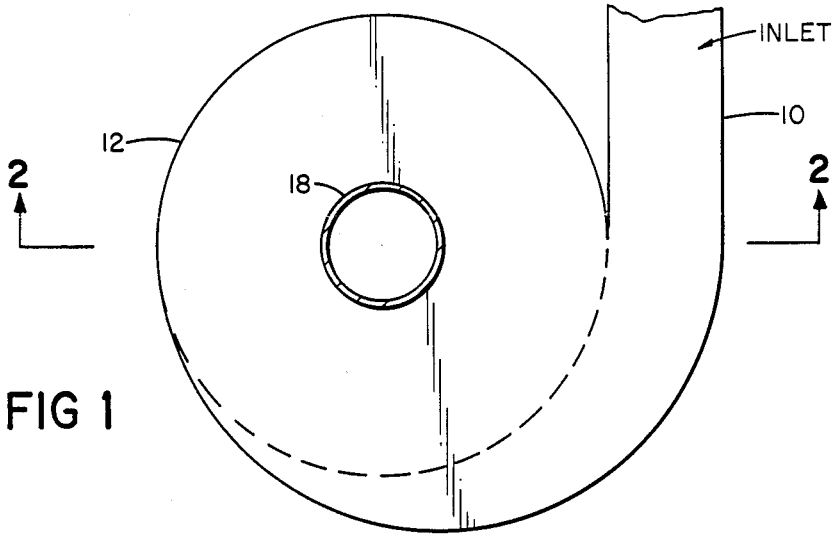
FIG. 1 is a sectional view of the cyclone classifier of the present invention.

The invention may be easily realized by modifying commercially available cyclones, such as the XQ 120 Series Cyclone, Size 10, manufactured by Fisher-Klosterman, Inc. Referring to FIG. 1, a cyclone comprises an inlet 10 which carries a mixture of air and particles of varying size, an upper cylindrical chamber 12 (26.5 inch I.D.), a lower conical chamber 13, a classifying air inlet 14, an air deflector 22, and an outlet 18. The inlet 10 is oriented tangentially to the circumference of the cylindrical chamber 12 in such manner as to cause swirling in the chamber 12. A second stream of air, known as classifying air, which enters the chamber 12 through classifying air inlet 14 and air deflector 22 (both of which are added as a modification), selectively removes lighter particles from the air, by carrying them in the exhaust airstream flowing out through outlet 18. The heavier particles are pulled downwardly by gravity and collected.

Figure 2:
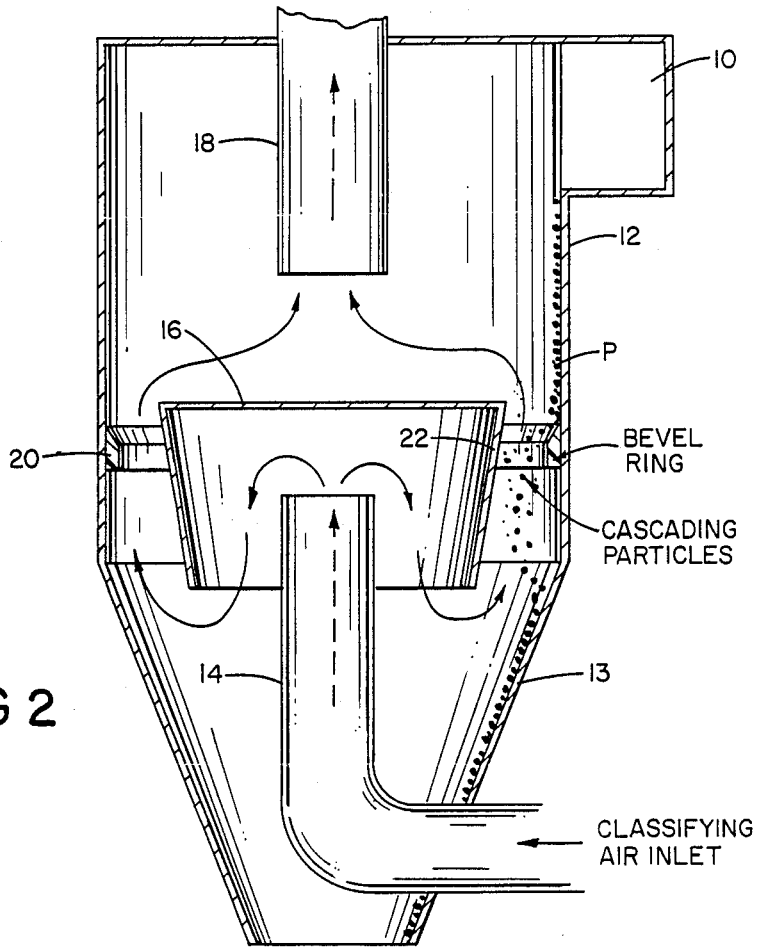
FIG. 2 is a sectional view of a cyclone classifier with adjustable classifying efficiency.

In order to prevent very fine particles from being trapped under larger particles on the wall of the cylinder and thus shielded from the classifying air, a bevel ring 20 is fixed to the inner wall of the cylindrical chamber 12 across from the air deflector 22, at about 10 inches above the boundary between cylindrical chamber 12 and conical chamber 13. The bevel ring 20 forces particles which are falling along the side of the chamber 12 inward, into the path of the classifying air, as shown diagrammatically by the dotted line in P in FIG. 2. In this manner, all particles are exposed to the classifying air, and efficiency of classification is improved.

The bevel ring may have a wide range of shapes and sizes. It is expected that the practical minimum and maximum thicknesses are 0.5% and 33% of the cyclone diameter. Good results have been achieved with a bevel ring thickness of ¼ inch (or 1% of cyclone diameter), and even better results with thicknesses of ½ inch (3%) and ¾ inch (7%). Accordingly, the range 3% to 7% is preferred.

A wide range of bevel angles are also possible. An angle of about 30° to 45° has proved most successful. If too large an angle is used (e.g., 90°), particles will accumulate on the upper surface of the ring, to form in effect a smaller angle. Too small an angle will not achieve the purpose of redirecting particles into the classifying air.

The vertical dimension, or height, of the bevel ring can also vary. Heights of 1 and 2 inches have worked successfully.

The vertical position of the bevel ring within the cyclone can be varied. It is preferable that it be positioned below the level at which substantially all the particles have been driven to the wall by the centrifugal action of the cyclone. If positioned higher, the improvement in classifying efficiency can be expected to lessen.

The invention's efficiency at removing very fine particles can be seen in examples of its use. In one application, the cyclone was operated with a particle loading of 0.15 lb. of powder per cubic meter of air, where the powder contained 2.6% fine particles, 5 microns or smaller. There were no particles detected at 5 microns or smaller after classification. When the particle loading was increased to 0.30 lb. per cubic meter, the classifier produced a powder with approximately 0.7% fines.

A comparison of classifying efficiency with and without the invention was conducted. Using a mixture of particles in which 4% were very fine (less than 5 microns), it was necessary, without the bevel ring installed, to exhaust one third of the particles to remove all of the very fine particles. With the bevel ring, however, all of the very fine particles could be removed with a loss of only 3% of the larger particles (7% of the total particles). Efficiency—i.e., the amount of waste of coarser particles required to achieve the desired reduction in fine particles—is dramatically better with the invention.

The invention is especially suited to efficiently removing very fine particles (less than 5 microns), but will improve the classifying efficiency of a cyclone for any size particle. For example, if it is desired to remove all 20 micron or smaller particles from a stream containing larger particles, the invention makes it possible to do so with less waste of particles larger than the 20 micron cutoff.

A further refinement in classifying efficiency is provided by air deflector 22 (FIG. 2), which is tapered so as to be narrower at the bottom end, and installed so as to vertically movable. The deflector has a 23.5 inch outside diameter at its top, an 18 inch outside diameter at its bottom, and an 18 inch overall height. Vertical adjustment of the deflector 22 has the benefit of allowing adjustment of the size of the annular orifice between the deflector 22 and the bevel ring 20, so that classification efficiency can be maximized for different operating conditions. Generally, narrowing the orifice will result in higher velocity of classifying air, leading to a more complete removal of fines but also the removal of more of the coarser particles. Conversely, widening the orifice tends to reduce the loss of coarse particles but also reduces the velocity of classifying air, and thus the degree of removal of fines.

Efficient classification of very fine particles has been achieved over a wide range of positions of the deflector 22, anywhere from the top of the deflector even with the bevel ring to the bottom of the deflector even with the bottom of the ring. If the deflector is raised higher, an undesirable turbulence seems to occur in the annular region between the deflector and the ring, with a resulting drop in efficiency. The deflector could be lowered below the height at which its top is even with the bevel ring, so long as the particles deflected by the ring do not travel onto the top of the deflector. The best efficiency seems to result when the bottom of the deflector is about two inches below the bottom of the bevel ring.

OTHER EMBODIMENTS

Other embodiments are within the following claims. For example, the bevel ring can be used in a nonclassifying cyclone (i.e., one used to separate all particles). In such an application it has the unexpected benfit of keeping fine particles from accumulating on the conical wall of the lower half of the cyclone.

I claim:

1. Cyclone classifying apparatus for separating fine particles from coarser particles suspended in a gaseous medium, said apparatus comprising, a housing, an inlet which introduces a gas-particle suspension into said housing tangentially so as to form a separating vortex in which said particles move under inertial forces, and without the influence of rotating baffles, to the wall of said housing and then fall downwardly, an outlet generally located on the upper portion of said housing, for carrying away unwanted exhaust containing said fine particles from said device, means for directing classifying air in an axial direction generally upwardly toward said outlet, said means comprising a classifying air inlet and an air deflector, wherein said air deflector is shaped to direct said classifying air upwardly through an annulus formed between said air deflector and said wall of said housing, and means for redirecting particles on the wall of said housing into the path of said classifying air, said means comprising an annular deflecting ring protruding from said wall of said housing in the path of said separated particles falling along said wall, said annular ring being positioned adjacent said annulus at a location where said classifying air is travelling upwardly in a nonturbulent flow insufficient to entrain said coarser particles, and said ring having a beveled top to deflect said particles on the wall inwardly.

2. The apparatus of claim 1 wherein said annular ring is at approximately the same height as said air deflector.

3. The apparatus of claim 1 wherein the interior surface of said housing is a surface of revolution and said air deflector is conical so as to allow adjustment of the annular orifice between said air deflector and said annular ring.

4. The apparatus of claim 1 wherein said air deflector is tapered so as to allow adjustment to the size of said narrow region.

5. The apparatus of claim 1 wherein said beveled top is beveled at an angle between 30° and 45° from vertical.

6. The apparatus of claim 1 wherein said housing has a circular cross section at the height of said annular ring.

7. The apparatus of claim 6 wherein the thickness of said annular ring is between 0.5% and 33% of the diameter of said circular cross section.

8. The apparatus of claim 6 wherein the thickness of said annular ring is between 1% and 7% of the diameter of said circular cross section.

9. The apparatus of claim 6 wherein the thickness of said annular ring is between 3% and 7% of the diameter of said circular cross section.

* * * * *